United States Patent [19]

Gaunt et al.

[11] Patent Number: 4,620,733

[45] Date of Patent: Nov. 4, 1986

[54] SHIPBOARD INTERNAL LOCKING SYSTEM

[75] Inventors: Joseph J. Gaunt; Bobby J. Leek, both of Oxnard, Calif.

[73] Assignee: The United States of America as represented by the Secretary of the Navy, Washington, D.C.

[21] Appl. No.: 751,157

[22] Filed: Jul. 2, 1985

[51] Int. Cl.[4] ..... E05C 9/12

[52] U.S. Cl. ..... 292/39; 292/70; 70/338; 70/120; 70/455

[58] Field of Search ..... 70/120, 338, 455, 424, 70/362; 292/7, 39, 153

[56] References Cited

U.S. PATENT DOCUMENTS

| | | | |
|---|---|---|---|
| 1,046,438 | 12/1912 | Caldwell | 70/120 X |
| 1,250,127 | 12/1917 | Beers | 70/DIG. 70 X |
| 1,464,458 | 8/1923 | Whartenby | 292/39 |
| 1,501,640 | 7/1924 | Anderson | 70/120 |
| 1,968,285 | 7/1934 | Egan | 292/39 X |
| 2,261,353 | 11/1941 | Fedele | 70/120 |
| 2,752,445 | 6/1956 | Navarrete | 70/120 X |
| 3,267,707 | 8/1966 | Adams | 70/455 |
| 4,070,882 | 1/1978 | Ruiz | 70/455 X |
| 4,288,944 | 9/1981 | Donovan | 292/39 X |
| 4,505,139 | 3/1985 | Richards | 70/DIG. 67 X |

*Primary Examiner*—Richard E. Moore
*Attorney, Agent, or Firm*—T. M. Phillips

[57] ABSTRACT

A locking bolt system for locking shipboard water tight doors, hatches and scuttles comprising plural bolts with racks thereon driven by pinions rotated by a drive shaft. Rotation of the drive shaft is controlled by a contoured locking disk which is locked and unlocked by two lugs each operated by an independent lock cylinder.

6 Claims, 7 Drawing Figures

SHIPBOARD INTERNAL LOCKING SYSTEM

BACKGROUND OF THE INVENTION

1. Field of the Invention

The present invention relates to locking devices and more particularly to locking devices of the sliding bar type.

2. Description of the Prior Art

Water tight doors, hatches and scuttles for naval ships require plural bolts to insure a sealed closure. Also where these closures are used to seal compartments where ammunition or arms or similar type stores are stored, maximum security is needed to prevent unauthorized persons from gaining entrance. There are several known lock and bolt arrangements, but they are very complicated and/or fail to meet the water tight and security requirements for naval ships such as those described in U.S. Pat. Nos. 3,792,885, 3,991,595, and 4,037,440. None of these mechanisims provide for plural bolts controlled by a single cam (for speed of operation) and with plural locking lugs operated by independent lock cylinders (for security), nor do they provide for water tight integrity.

SUMMARY OF THE INVENTION

According to the present invention there is provided a locking bolt system comprising plural bolts with racks thereon driven by pinions rotated by a drive shaft. Rotation of the drive shaft is controlled by a cam which is locked and unlocked by a plurality of lugs each operated by an independent lock cylinder.

Accordingly, an object of the invention is to provide a locking bolt system for locking shipboard water tight doors and the like including a plurality of bolts with racks thereon driven by pinions rotated by a drive shaft controlled by a cam which is locked and unlocked by a plurality of lugs each operated by an independent lock cylinder.

Other objects, advantages and novel features of the invention will become apparent from the following detailed description of the invention when considered in conjunction with the accompanying drawings.

DESCRIPTION OF THE PREFERRED EMBODIMENT

Figure 1:
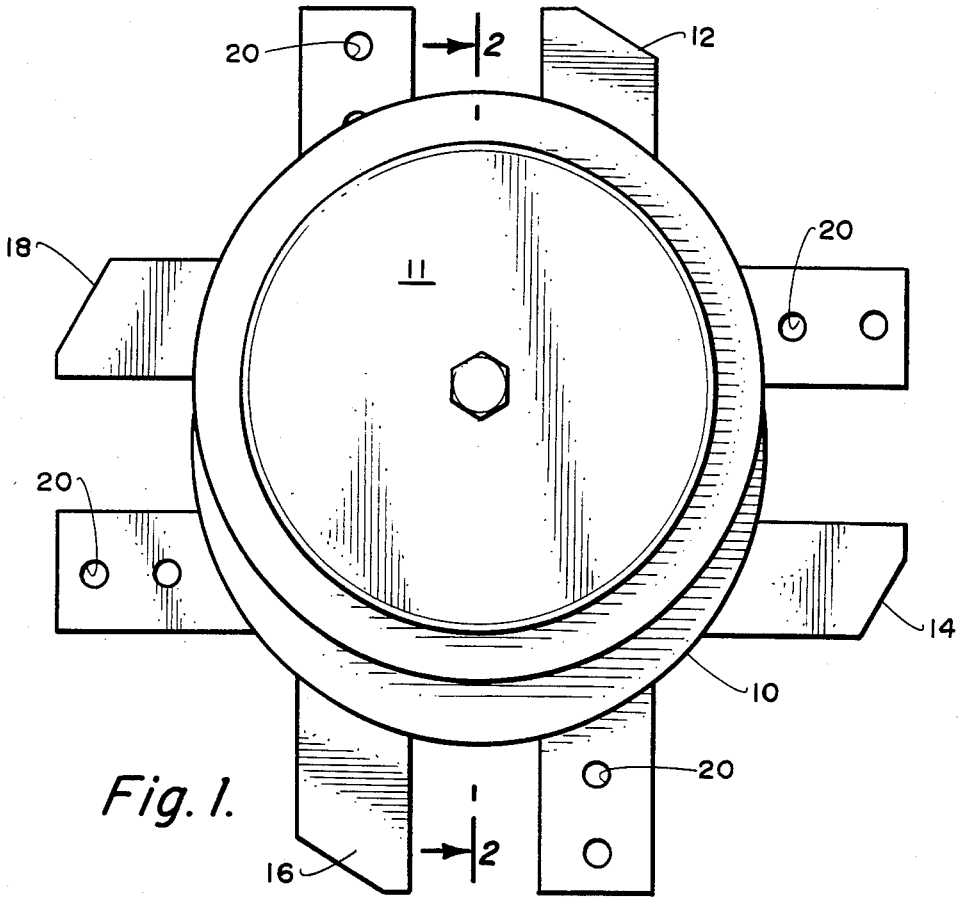
FIG. 1 is a perspective overall view of an embodiment of the invention.

The locking bolt system illustrated in the drawings is to provide four-point locking of doors and hatches. The locking system is enclosed in a housing 10 with a water tight cover plate 11. Four locking bars 12, 14, 16 and 18 are shown projecting from the housing 10. Mounting holes 20 are shown for attaching extension bolts of appropriate length for any door configuration.

Figure 2:
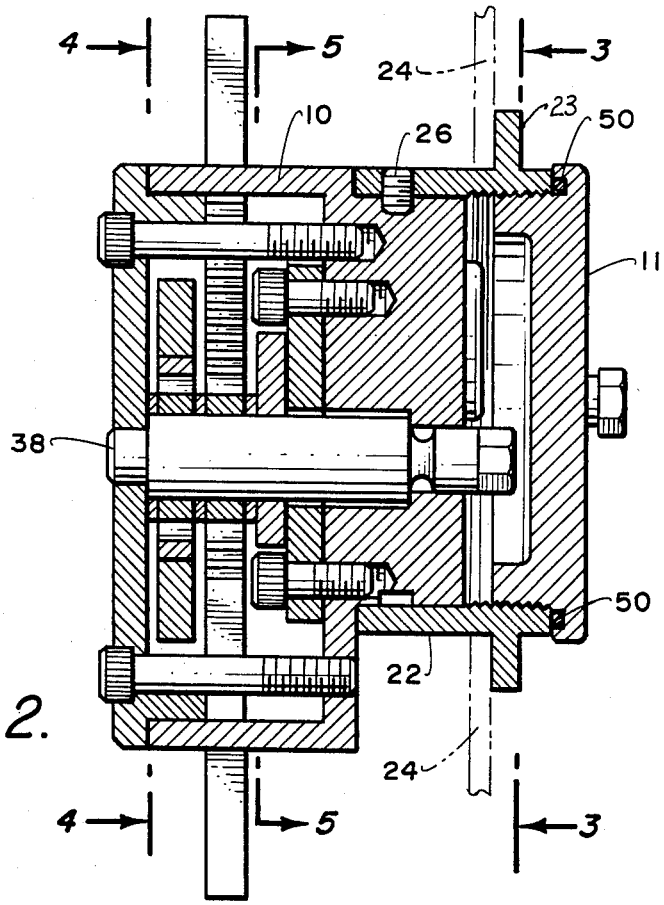
FIG. 2 is a sectional view in cross section substantially on a broken line 2—2 of FIG. 1.
Figure 3:
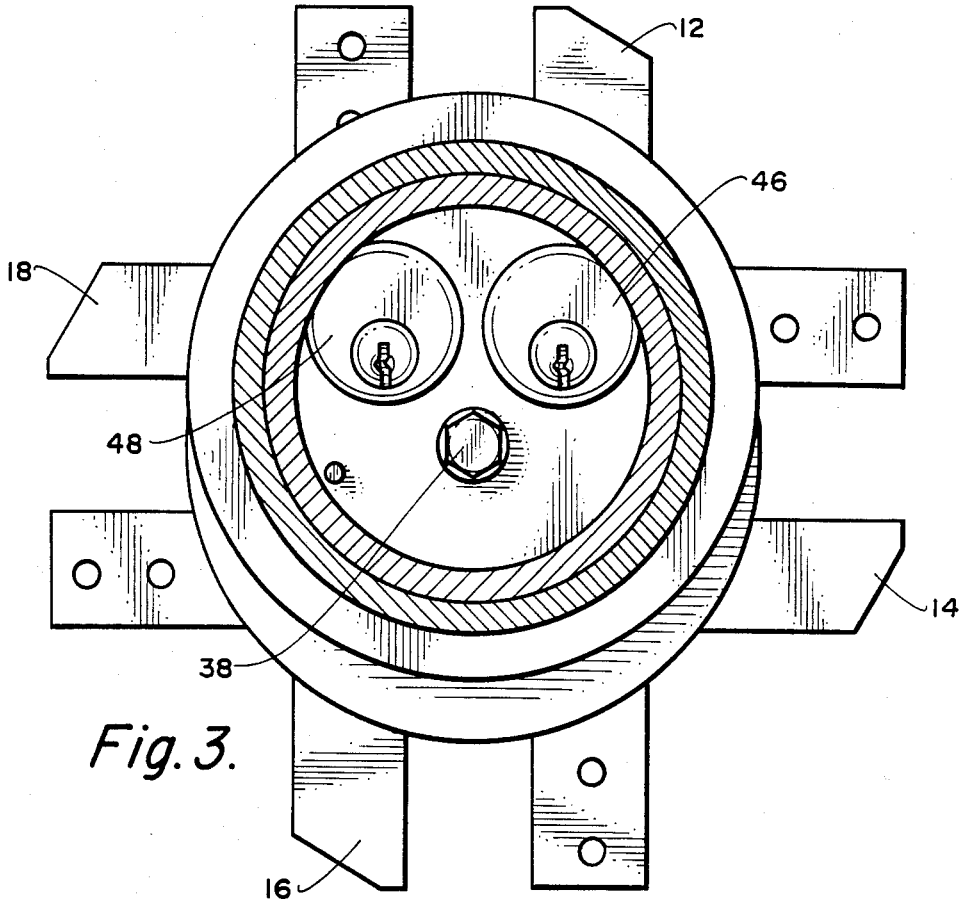
FIG. 3 is a view in cross section substantially on a broken line 3—3 of FIG. 2.

As shown in FIG. 2, housing 10 is mounted in a sleeve 22. Sleeve 22 is provided with a flange 23 to facilitate its being mounted in the door 24 from the outside and secured in place by welding or any any other suitable means. Six screws 26 hold the housing 10 firmly in sleeve 12, in any axial position required for bolts 12, 14, 16, and 18 to interlock with the door frame, but not to interfere with the door structure or sealing mechanisms.

Figure 4:
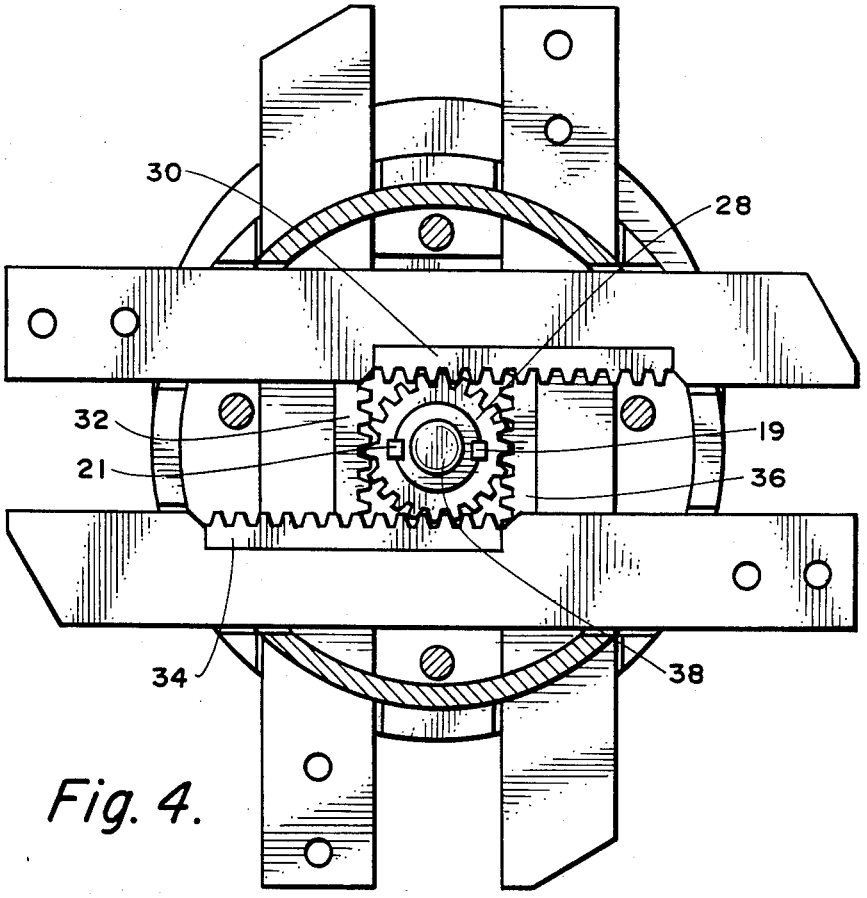
FIG. 4 is a sectional view substantially on a broken line 4—4 of FIG. 2.
Figure 5:
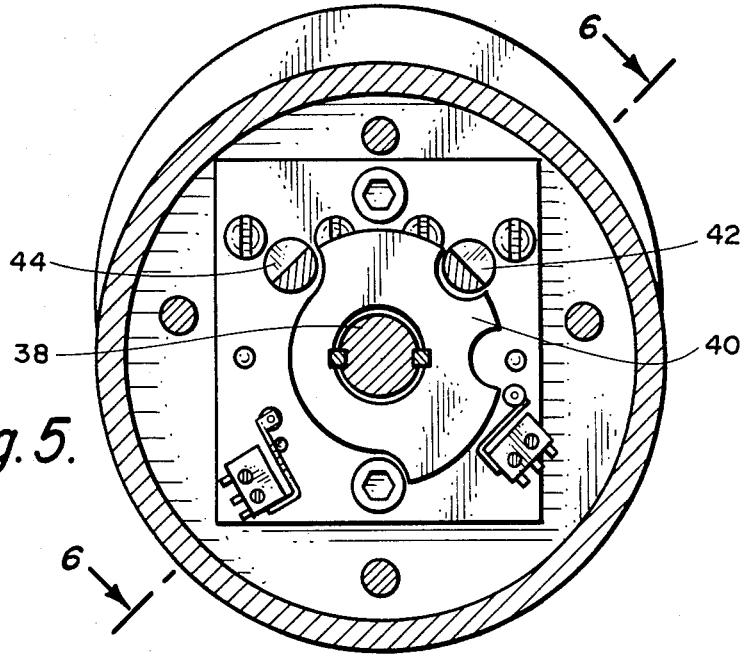
FIG. 5 is a sectional view substantially on a broken line 5—5 of FIG. 2.
Figure 6:
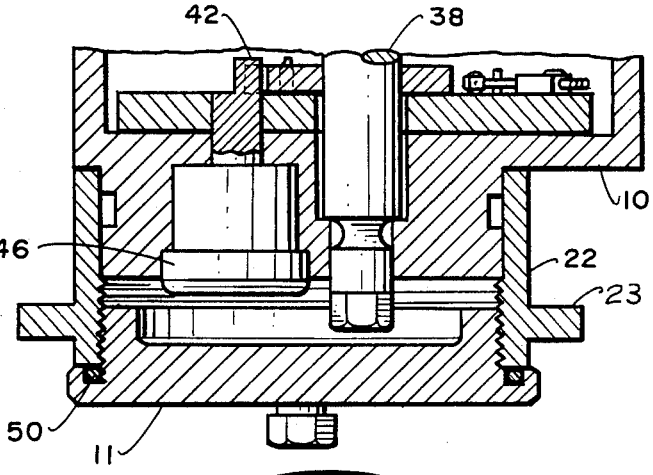
FIG. 6 is a partial sectional view substantially on a line 6—6 of FIG. 5.
Figure 7:
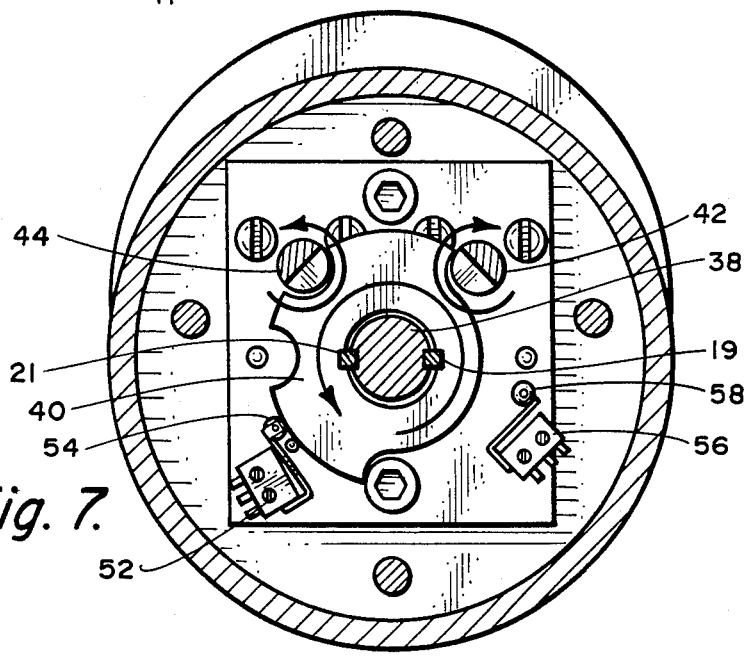
FIG. 7 is the same view as FIG. 5 except the cam and lugs are rotated to the unlocked position.

Once the lock is installed, the bolts are extended and withdrawn by means of two pinion gears 28 and driving racks 30, 32, 34, and 36 (FIG. 4). Pinion gears 28 are mounted on shaft 38 by means of keys 19 and 21 and are driven by drive shaft 38 when it is rotated by means of a tool (not shown) from outside the door. Rotation of drive shaft 38 is controlled by a contoured locking disk 40. Disk 40 is locked and unlocked by two lugs 42 and 44. Lugs 42 and 44 are each rotated, respectively by lock cylinders 46 and 48. To gain access to lock cylinders 46 and 48, and drive shaft 38, water tight cover 11 must be removed. Cover 11 is screwed into the threaded end of sleeve 22 and is sealed against the end of sleeve 22 by means of O-ring seal 50.

To provide additional security, microswitch 52 is actuated by roller 54 when disk 40 is moved from the locked position to the unlocked position while microswitch 56 is actuated when cover 11 is removed allowing pin 58 to retract.

Obviously many modifications and variations of the present invention are possible in the light of the above teachings. It is therefore to be understood that within the scope of the appended claims, the invention may be practiced otherwise than as specifically described.

What is claimed is:

1. A locking bolt system comprising:

a. a plurality of bolts having racks mounted thereon and being driven by pinions rotated by a drive shaft;

b. rotation of said drive shaft being associated with a rotatable contoured locking disk positionable for controlling the rotation thereof;

c. said disk being locked and unlocked by two lugs, each of said lugs being operated by an independent lock cylinder and both of said two lugs required to be in the unlocked position before said disk is free to allow rotation of said drive shaft;

d. said disk having two cavities into which said two lugs are positioned for preventing rotation of said disk and said drive shaft; and when each of said lugs is rotated away from said cavities permitting rotation of said disk and said drive shaft when each of said lugs is in the unlocked position;

e. said locking bolt system being positioned on the interior of a water tight door and access to said lock cylinders being through an opening covered by a removable screw cap;

f. alarm switch means for monitoring operation and tampering of said locking system;

g. said alarm switch means including switch actuating means extending through said door and being actuated when said screw cap is removed.

2. A locking bolt system for locking shipboard water tight doors and the like comprising:

a. a threaded sleeve inserted from the exterior side of a door and being substantially flush with the outside of said door for receiving a screw cap to provide a water tight seal;

b. a housing mounted in said sleeve from the interior of said door;

c. a locking device mounted in said housing and including:

1. a plurality of bolts having racks mounted thereon and being driven by pinions rotated by a drive shaft,
2. rotation of said drive shaft being associated with a contoured locking disk for controlling the rotation thereof,
3. said disk being locked and unlocked by two lugs, each of said lugs being operated by an independent lock cylinder, d. locking and unlocking of said lock cylinders and rotation of said drive shaft being accessible from the exterior of said door when said screw cap is removed from the exterior of said sleeve.

3. The locking bolt system of claim 2 further including an alarm switch means for monitoring operation and tampering of said locking system.

4. The locking bolt system of claim 3 wherein said alarm switch means includes switch actuating means extending through said door and being actuated when said screw cap is removed.

5. A locking bolt system for locking shipboard gas tight doors and the like comprising:

a. a threaded sleeve inserted from the exterior side of a door and being substantially flush with the outside of said door for receiving a screw cap to provide a gas tight seal;

b. housing mounted in said sleeve from the interior of said door;

c. a locking and unlocking device mounted in said housing and including:

1. a plurality of bolts having racks mounted thereon and being driven by pinions rotated by a drive shaft,
2. rotation, of said drive shaft being associated with a contoured locking disk for controlling the rotation thereof,
3. said disk being locked and unlocked by two lugs, each of said lugs being operated by an independent lock cylinder, d. locking and unlocking of said lock cylinders and rotation of said drive shaft being accessible from the exterior of said door when said screw cap is removed from the exterior of said sleeve.

6. A locking bolt system for locking shipboard vapor tight doors and the like comprising:

a. a threaded sleeve inserted from the exterior side of a door and being substantially flush with the outside of said door for receiving a screw cap to provide a vapor tight seal;

b. a housing mounted in said sleeve from the interior of said door;

c. a locking and unlocking device mounted in said housing and including:

1. a plurality of bolts having racks mounted thereon and being driven by pinions rotated by a drive shaft,
2. rotation of said drive shaft being associated with a contoured locking disk for controlling the rotation thereof,
3. said disk being locked and unlocked by two lugs, each of said lugs being operated by an independent lock cylinder, d. locking and unlocking of said lock cylinders and rotation of said drive shaft being accessible from the exterior of said door when said screw cap is removed from the exterior of said sleeve.

* * * * *